US010843310B2

(12) United States Patent
Dohi

(10) Patent No.: US 10,843,310 B2
(45) Date of Patent: Nov. 24, 2020

(54) CLAMP DEVICE

(71) Applicant: FANUC CORPORATION, Yamanashi (JP)

(72) Inventor: Yoshiaki Dohi, Yamanashi-ken (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/454,306

(22) Filed: Jun. 27, 2019

(65) Prior Publication Data

US 2020/0001436 A1 Jan. 2, 2020

(30) Foreign Application Priority Data

Jun. 28, 2018 (JP) ..... 2018-123288

(51) Int. Cl.

| | |
|---|---|
| ***B25B 1/00*** | (2006.01) |
| ***B25B 5/08*** | (2006.01) |
| ***B25B 5/14*** | (2006.01) |
| ***B25B 5/04*** | (2006.01) |

(52) U.S. Cl.

CPC ..... *B25B 5/08* (2013.01); *B25B 5/04* (2013.01); *B25B 5/14* (2013.01)

(58) Field of Classification Search

CPC ..... B25B 1/00; B25B 1/08; B25B 1/2452; B25B 1/2478

See application file for complete search history.

(56) References Cited

U.S. PATENT DOCUMENTS 3,643,501 A * 2/1972 Pauley ..... B25B 23/147 73/862.24
2008/0087144 A1* 4/2008 Rollins ..... H01R 43/0427 81/301
2008/0222867 A1* 9/2008 Robarge ..... F16K 31/46 29/221.6
2014/0150610 A1* 6/2014 McMenemy ..... F16H 57/082 81/57.39
2015/0251256 A1* 9/2015 Frenken ..... B26B 15/00 100/234
2016/0288193 A1* 10/2016 Thorson ..... F16H 25/20

(Continued)

FOREIGN PATENT DOCUMENTS

JP S54006689 U 1/1979
JP S59064241 A 4/1984

(Continued)

OTHER PUBLICATIONS

English Machine Translation for Japanese Publication No. JPS54-006689U, published Jan. 17, 1979, 4 pgs.

(Continued)

*Primary Examiner* — Lee D Wilson
(74) *Attorney, Agent, or Firm* — Fredrikson & Byron, P.A.

(57) ABSTRACT

A clamp device for clamping a workpiece includes: clamp arms configured to restrict movement of the workpiece by turning; a cam block configured to turn the clamp arms by turning; a workpiece base on which the workpiece is placed; a motor configured to rotate a driving shaft to thereby turn the cam block and move the driving shaft in an axial direction; and a coupling mechanism configured to couple the driving shaft and the clamp arms and to move the clamp arms toward the workpiece base as the driving shaft is moved in the axial direction.

5 Claims, 13 Drawing Sheets

(56) References Cited

U.S. PATENT DOCUMENTS

| | | | | |
|---|---|---|---|---|
| 2018/0162006 | A1* | 6/2018 | Kettula | B26D 1/56 |
| 2020/0001436 | A1* | 1/2020 | Dohi | B25B 5/04 |
| 2020/0070329 | A1* | 3/2020 | Buck | B25B 27/10 |

FOREIGN PATENT DOCUMENTS

| | | | |
|---|---|---|---|
| JP | S62297003 | A | 12/1987 |
| JP | 2005271121 | A | 10/2005 |

OTHER PUBLICATIONS

English Abstract and Machine Translation for Japanese Publication No. JPS62-297003A, published Dec. 24, 1987, 4 pgs.
English Machine Translation for Japanese Publication No. 2005-271121 A, published Oct. 6, 2005, 7 pgs.
English Abstract and Machine Translation for Japanese Publication No. JPS59-064241A, published Apr. 12, 1984, 5 pgs.
English Machine Translation of Decision to Grant a Patent mailed by Japan Patent Office (JPO) for Application No. JP2018-123288, dated May 26, 2020, 2 pages.
Untranslated Decision to Grant a Patent mailed by Japan Patent Office (JPO) for Application No. JP2018-123288, dated May 26, 2020, 3 pages.
English Machine Translation of Notification of Reasons for Refusal mailed by Japan Patent Office (JPO) for Application No. JP2018-123288, dated Feb. 12, 2020, 3 pages.
Untranslated Notification of Reasons for Refusal mailed by Japan Patent Office (JPO) for Application No. JP2018-123288, dated Feb. 2, 2020, 3 pages.

* cited by examiner

CLAMP DEVICE

CROSS-REFERENCE TO RELATED APPLICATION

This application is based upon and claims the benefit of priority from Japanese Patent Application No. 2018-123288 filed on Jun. 28, 2018, the contents of which are incorporated herein by reference.

BACKGROUND OF THE INVENTION

Field of the Invention

The present invention relates to a clamp device for clamping a workpiece.

Description of the Related Art

Japanese Laid-Open Patent Publication No. 2005-271121 discloses a workpiece clamping device that attracts a lower surface of a workpiece with a magnet and clamps a side surface of the workpiece with clampers.

SUMMARY OF THE INVENTION

The workpiece clamping device of the technique of Japanese Laid-Open Patent Publication No. 2005-271121 attracts the workpiece by a magnet and therefore cannot clamp a workpiece made of nonmagnetic material.

The present invention has been devised in order to solve the problem above, and an object of the present invention is to provide a clamp device that can clamp nonmagnetic workpieces.

According to an aspect of the present invention, a clamp device for clamping a workpiece includes: clamp arms configured to restrict movement of the workpiece by turning; a cam block configured to turn the clamp arms by turning; a workpiece base on which the workpiece is placed; a driving shaft that is a member formed into a rod shape, the driving shaft being configured to be screw-engaged, at a middle portion thereof, with a screw portion formed in the workpiece base and also screw-engaged, at one end thereof, with a screw portion formed on a pivot axis of the cam block; a motor configured to rotate the driving shaft to thereby turn the cam block and move the driving shaft in an axial direction; and a coupling mechanism configured to couple the driving shaft and the clamp arms and move the clamp arms toward the workpiece base as the driving shaft is moved in the axial direction.

According to the present invention, it is possible to clamp nonmagnetic workpieces.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

First Embodiment

[Configuration of Clamp Device]

Figure 1:
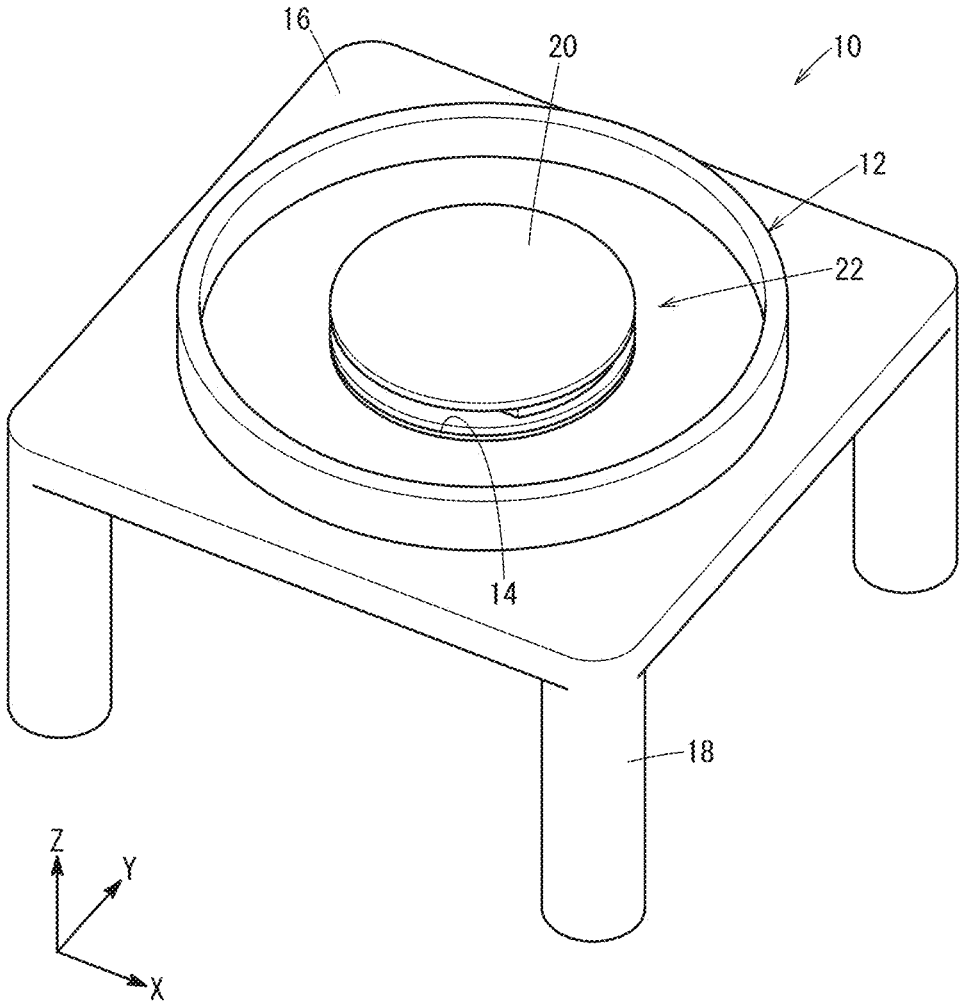
FIG. 1 is a perspective view of a clamp device.

FIG. 1 is a perspective view of a clamp device 10. The clamp device 10 of this embodiment is inserted in a through hole 14 formed in a workpiece 12 and clamps the workpiece 12 by pressing the workpiece 12 against a workpiece base 16 from above. The clamp device 10 is employed with leg portions 18 of the workpiece base 16 being fixed to a worktable of a machine tool. In the description below, X-axis, Y-axis, and Z-axis are set in the directions shown in FIG. 1, and the drawings other than FIG. 1, which will be explained later, will also show axes corresponding to the X-axis, Y-axis, and Z-axis of FIG. 1.

Figure 2A:
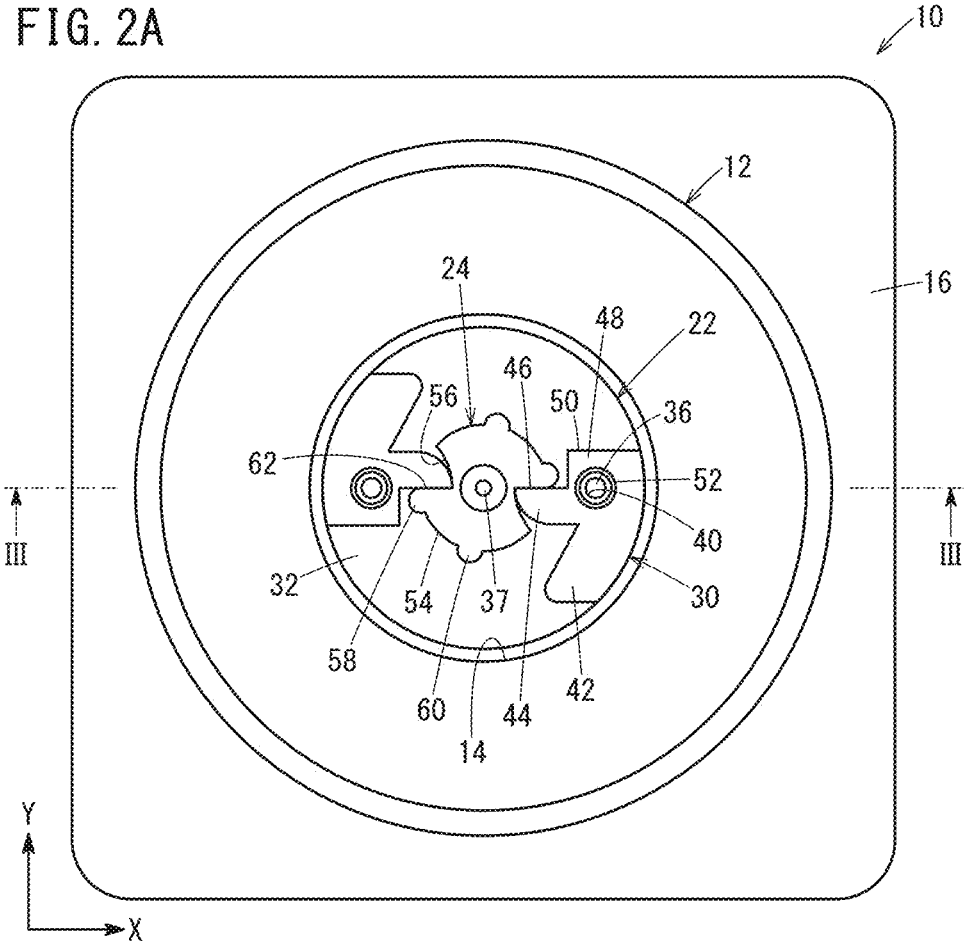
FIG. 2A is a top view of the clamp device seen from a Z-axis positive direction side.
Figure 2B:
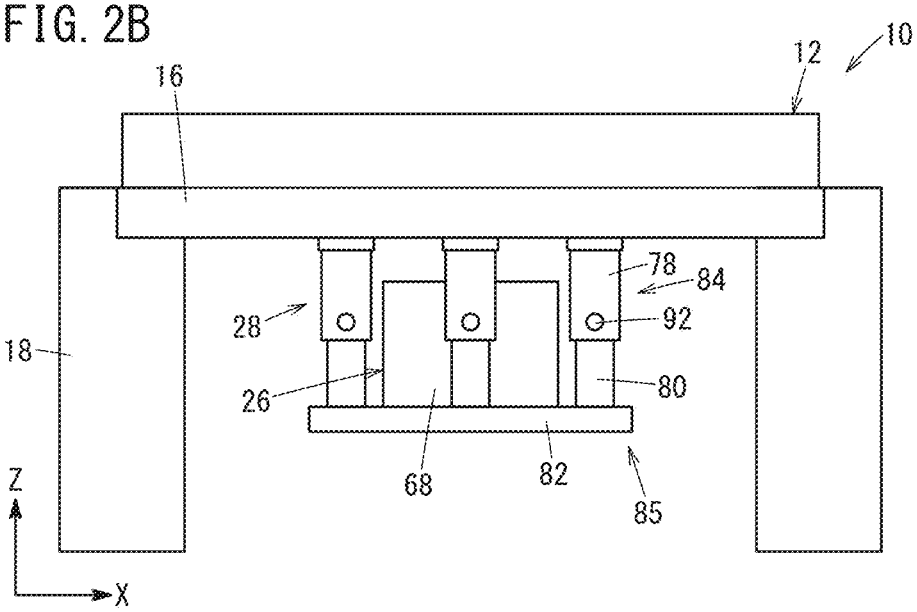
FIG. 2B is a side view of the clamp device seen from a Y-axis negative direction side.
Figure 3:
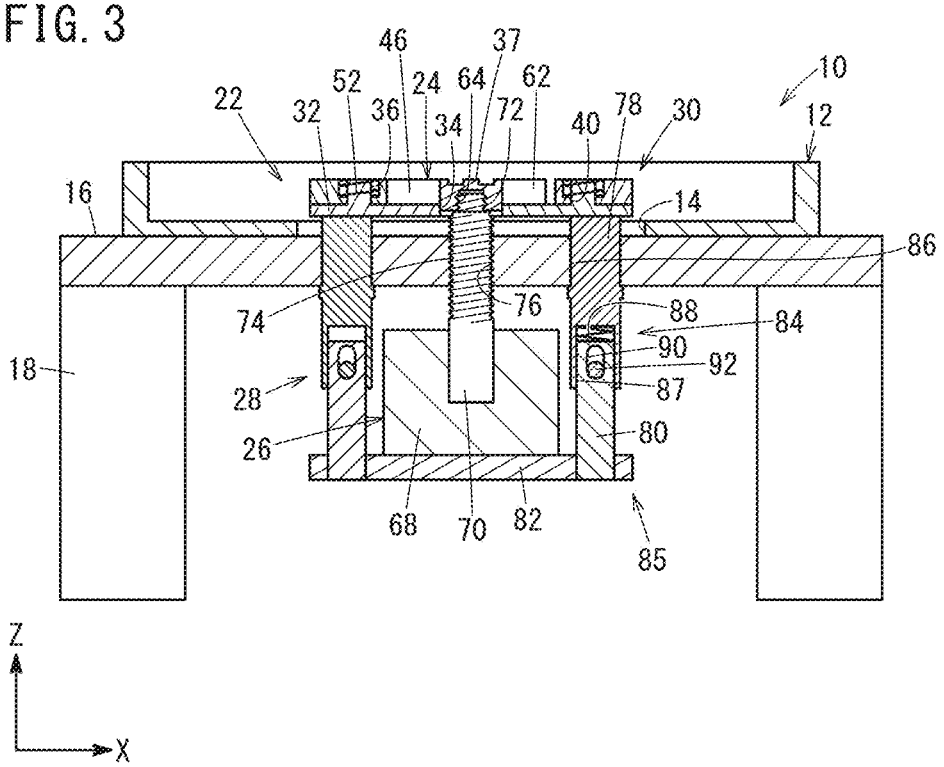
FIG. 3 is a cross section taken along line III-III shown in FIG. 2A.
Figure 4:
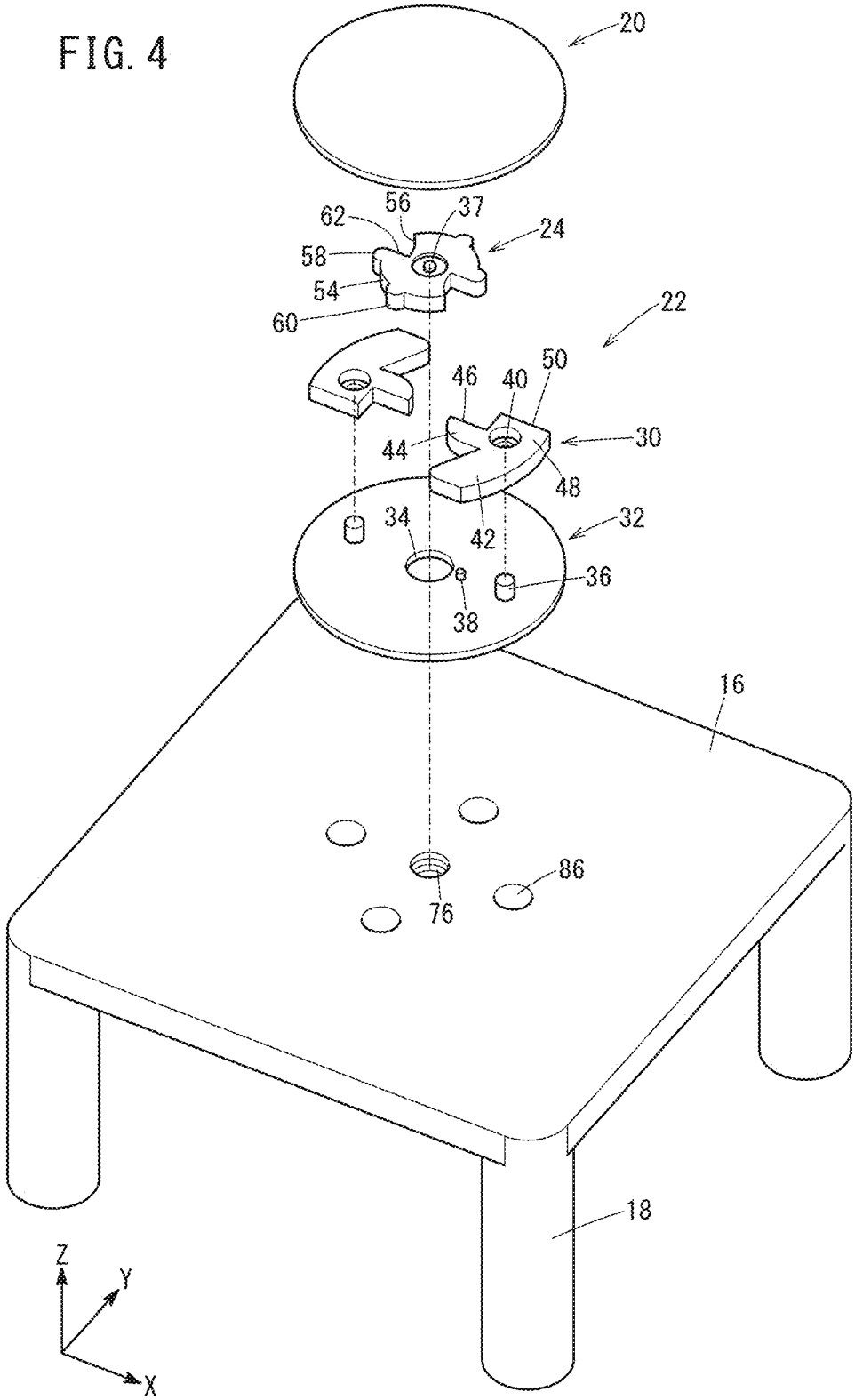
FIG. 4 is an exploded perspective view of a clamping mechanism.

FIG. 2A is a top view of the clamp device 10 seen from a Z-axis positive direction side. FIG. 2B is a side view of the clamp device 10 seen from a Y-axis negative direction side. FIG. 3 is a cross section taken along line III-III in FIG. 2A. A cover 20 is omitted in FIGS. 2A, 2B and 3. FIG. 4 is an exploded perspective view of a clamping mechanism 22.

Figure 5A:
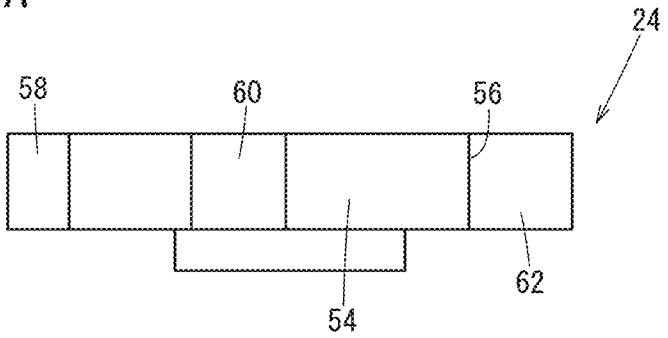
FIG. 5A is a side view of a cam block.
Figure 5B:
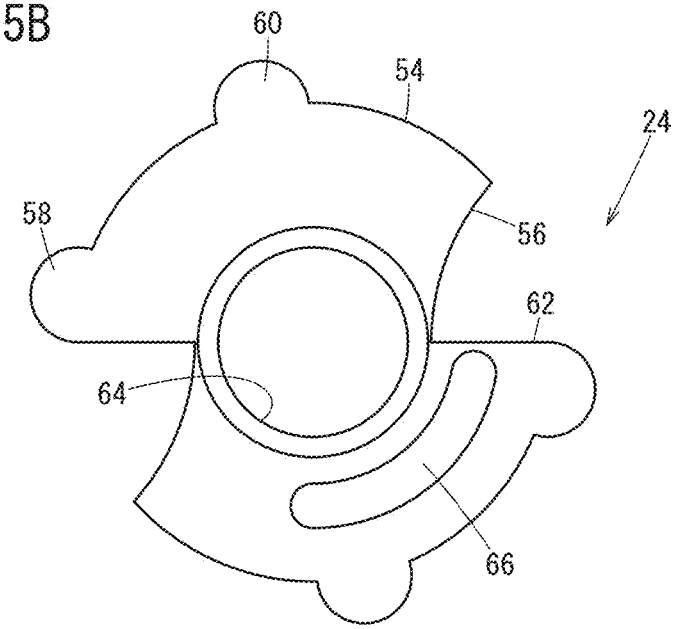
FIG. 5B is a bottom view of the cam block.

FIG. 5A is a side view of a cam block 24. FIG. 5B is a bottom view of the cam block 24.

The clamp device 10 includes the clamping mechanism 22, a driving mechanism 26, a suspension mechanism 28, and the workpiece base 16.

[Configuration of Clamping Mechanism]

The clamping mechanism 22 includes clamp arms 30, the cam block 24, a clamp base 32, and the cover 20. The clamp base 32 is a substantially disc-shaped member, which has a through hole 34 formed at its center (FIGS. 3 and 4). The clamp base 32 has two support shafts 36 projecting on the Z-axis positive direction side (FIG. 4). The clamp base 32 has a stopper 38 projecting on the Z-axis positive direction side (FIG. 4). The stopper 38 is formed between a support shaft 36 and the through hole 34.

Each clamp arm 30 has a support hole 40 formed therein, and the support shaft 36 on the clamp base 32 is inserted in the support hole 40 (FIGS. 2A, 3, and 4). The clamp arms 30 can thus pivot on the respective support shafts 36.

Each clamp arm 30 has an arm portion 42 that has its side surface formed in an arc shape along the outer shape of the clamp base 32. Each clamp arm 30 has a lever portion 44 that is formed to extend in an inner circumference direction of the clamp base 32. The lever portion 44 has a first working face 46 formed on a side surface thereof and extending in the radial direction of the support hole 40. Each clamp arm 30 has a head portion 48 across the support hole 40 from the arm portion 42. A side surface of the head portion 48 has a second working face 50 formed in substantially parallel with the first working face 46.

A spring 52 is provided between the support hole 40 of each clamp arm 30 and the support shaft 36 of the clamp base 32 (FIG. 3). The spring 52 biases the clamp arm 30 such that the clamp arm 30 turns in such a direction that the arm portion 42 of the clamp arm 30 moves toward the side of the inner circumference of the clamp base 32 (in a clockwise direction seen from the Z-axis positive direction side: FIG. 2A).

The cam block 24 is formed in a shape in which parts of a disk are removed, and it has two arc portions 54 and two notches 56. The cam block 24 is supported by the cover 20 such that it can pivot on a pivot axis 37. A spring (not shown) is provided between the pivot axis 37 of the cam block 24 and the cover 20. The spring biases the cam block 24 such that the cam block 24 pivots clockwise seen from the Z-axis positive direction side.

When the cam block 24 is seen from the Z-axis positive direction side, the side surfaces of the arc portions 54 are formed in an arc shape around the pivot axis 37. A first cam 58 and a second cam 60 are formed on the side surface of each of the arc portions 54 (FIGS. 2A, 4, and 5B). When the cam block 24 is seen from the Z-axis positive direction side, each notch 56 has a cam face 62 extending outwardly in the radial direction with respect to the pivot axis 37 (FIGS. 2A and 5B). In the surface of the cam block 24 on the Z-axis negative direction side, a first female screw portion 64 is formed coaxially with the pivot axis 37, and an arc-shaped groove 66 is formed in an arc shape (FIG. 5B). The stopper 38 on the clamp base 32 is engaged into the arc-shaped groove 66. The range in which the cam block 24 can turn is limited by the stopper 38 within a range of about 90° in the clockwise direction from the position shown in FIG. 2A.

[Configuration of Driving Mechanism]

Figure 11:
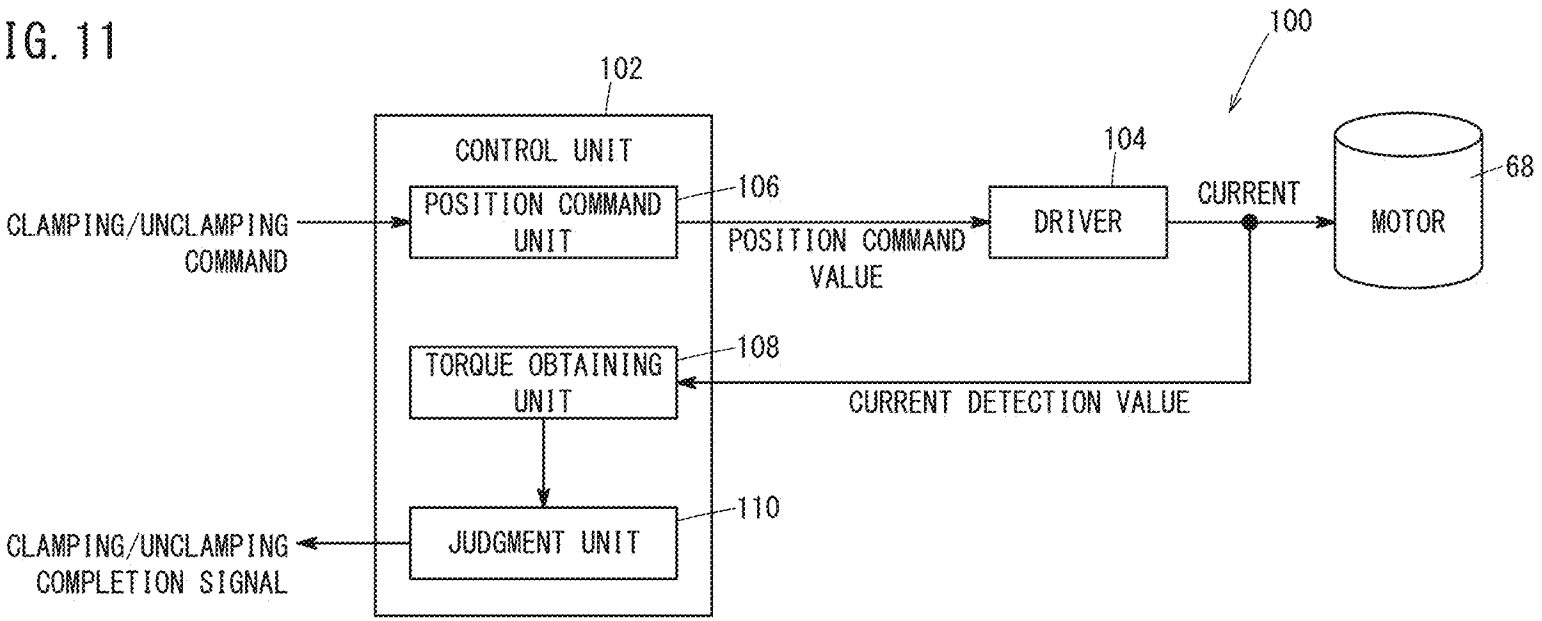
FIG. 11 is a block diagram showing the configuration of a motor control device.

The driving mechanism 26 includes a motor 68 and a driving shaft 70. The motor 68 is a servomotor, for example, which rotates the driving shaft 70 under a control by a motor control device 100 that will be described later (FIG. 11). The driving shaft 70 is formed into a round bar shape, which has a threaded, first male screw portion 72 at its end portion and a threaded, second male screw portion 74 at its middle portion. The first male screw portion 72 is screw-engaged with the first female screw portion 64 of the cam block 24. The second male screw portion 74 is screw-engaged with a second female screw portion 76 that is formed so as to penetrate through the workpiece base 16 and tapped on its inner circumferential surface.

[Configuration of Suspension Mechanism]

The suspension mechanism 28 includes first guide shafts 78, second guide shafts 80, a motor base 82, and coupling portions 84. The suspension mechanism 28 and the clamp base 32 constitute a coupling mechanism 85.

The first guide shafts 78 are fixed to the surface of the clamp base 32 on the Z-axis negative direction side (FIG. 3). The first guide shafts 78 are inserted respectively in through holes 86 penetrating through the workpiece base 16. The first guide shafts 78 are provided so as to be movable together with the clamp base 32 in the Z-axis direction with respect to the workpiece base 16.

The second guide shafts 80 are fixed to the surface of the plate-shaped motor base 82 on the Z-axis positive direction side (FIGS. 2B and 3). The motor 68 is fixed on the surface of the motor base 82 on the Z-axis positive direction side (FIGS. 2B and 3).

The end portion of each first guide shaft 78 on the Z-axis negative direction side has a hollow portion 87 that opens in the Z-axis negative direction. The end portions of the second guide shafts 80 on the Z-axis positive direction side are respectively inserted in the hollow portions 87. A spring 88 is provided between the end portion of each second guide shaft 80 and a bottom portion of the hollow portion 87. The springs 88 bias the second guide shafts 80 to the Z-axis negative direction side with respect to the first guide shafts 78.

Each second guide shaft 80 has a pin hole 90 that penetrates through in a direction perpendicular to the axial direction. The pin hole 90 is formed in the shape of an elongated hole extending in the Z-axis direction. A pin 92 fixed to the first guide shaft 78 is inserted into the pin hole 90. This permits the second guide shafts 80 to move in the Z-axis direction with respect to the first guide shafts 78 within a certain range. The pin holes 90 and the pins 92 constitute the coupling portions 84.

[Movement of Clamp Device]

Figure 6A:
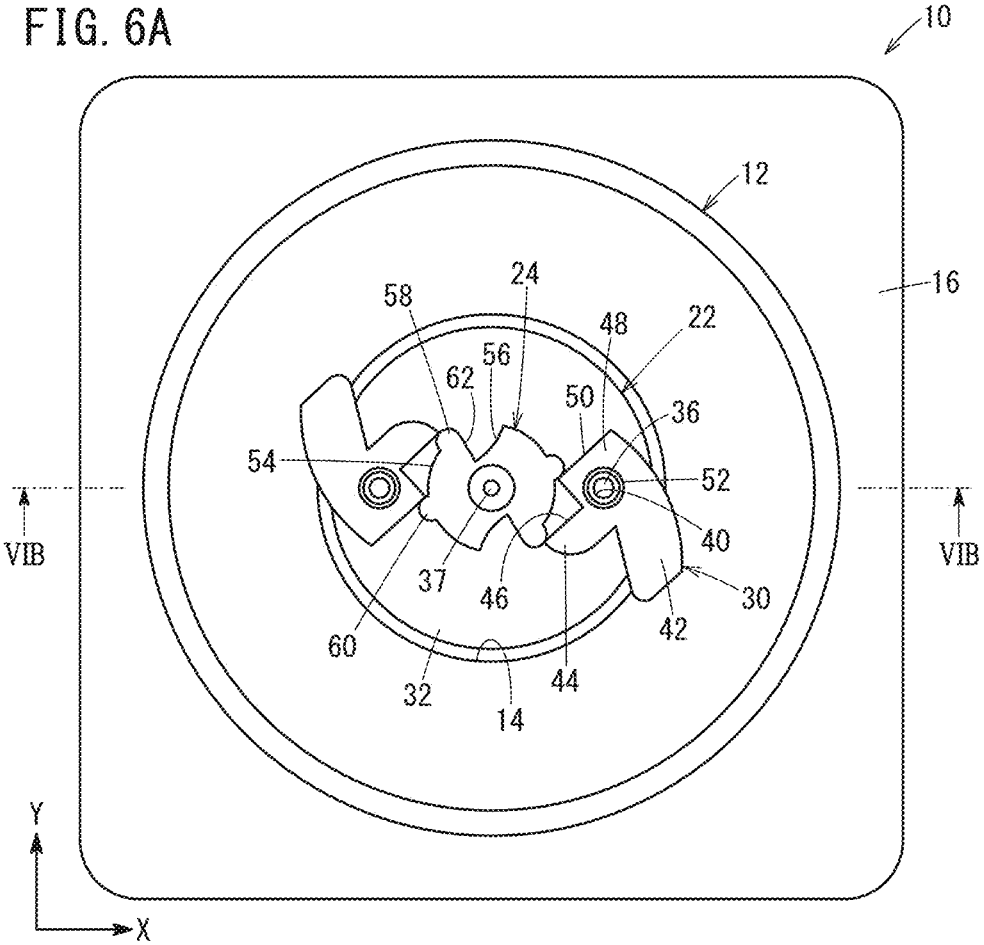
FIG. 6A is a top view of the clamp device during a clamping operation seen from the Z-axis positive direction side.
Figure 6B:
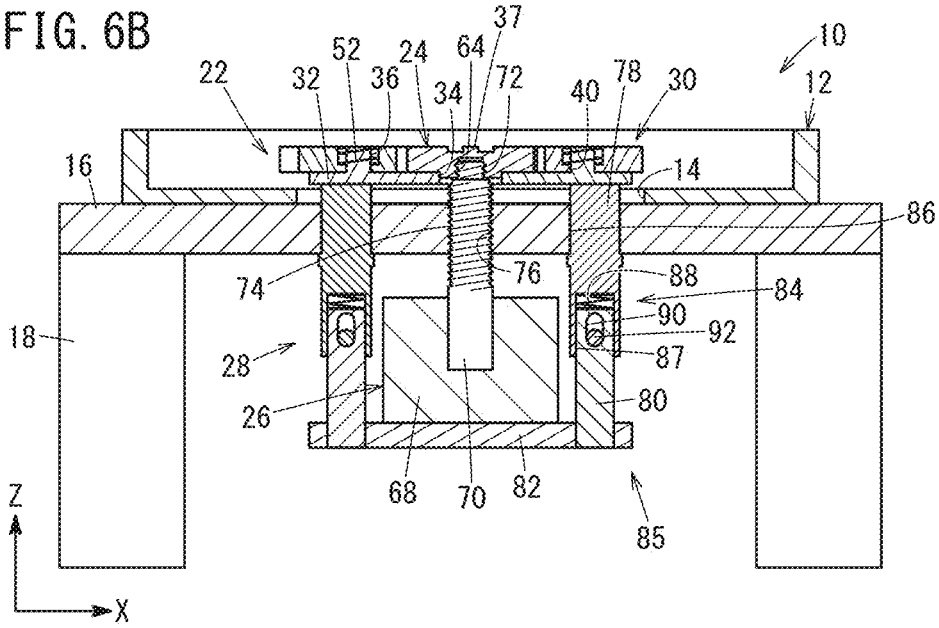
FIG. 6B is a cross section taken along line VIB-VIB shown in FIG. 6A.
Figure 7A:
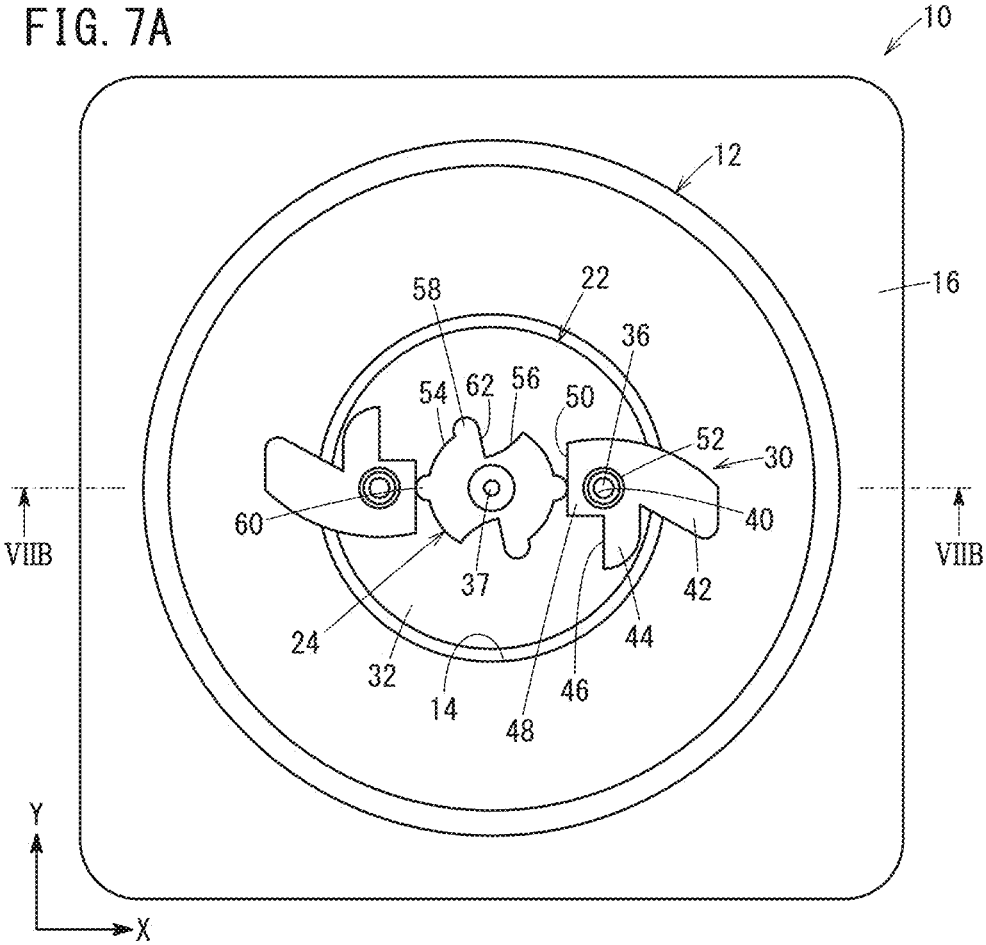
FIG. 7A is a top view of the clamp device during the clamping operation seen from the Z-axis positive direction side.
Figure 7B:
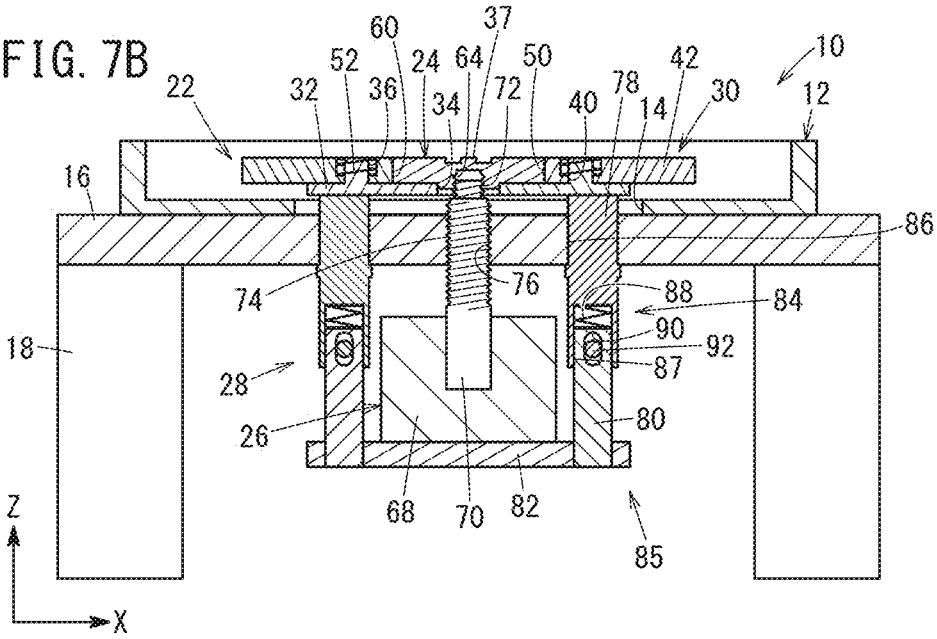
FIG. 7B is a cross section taken along line VIIB-VIIB shown in FIG. 7A.

FIG. 6A is a top view of the clamp device 10 during a clamping operation, seen from the Z-axis positive direction side. FIG. 6B is a cross section taken along line VIB-VIB shown in FIG. 6A. FIG. 7A is a top view showing the clamp device 10 during the clamping operation, seen from the Z-axis positive direction side. FIG. 7B is a cross section taken along line VIIB-VIIB shown in FIG. 7A.

Figure 8A:
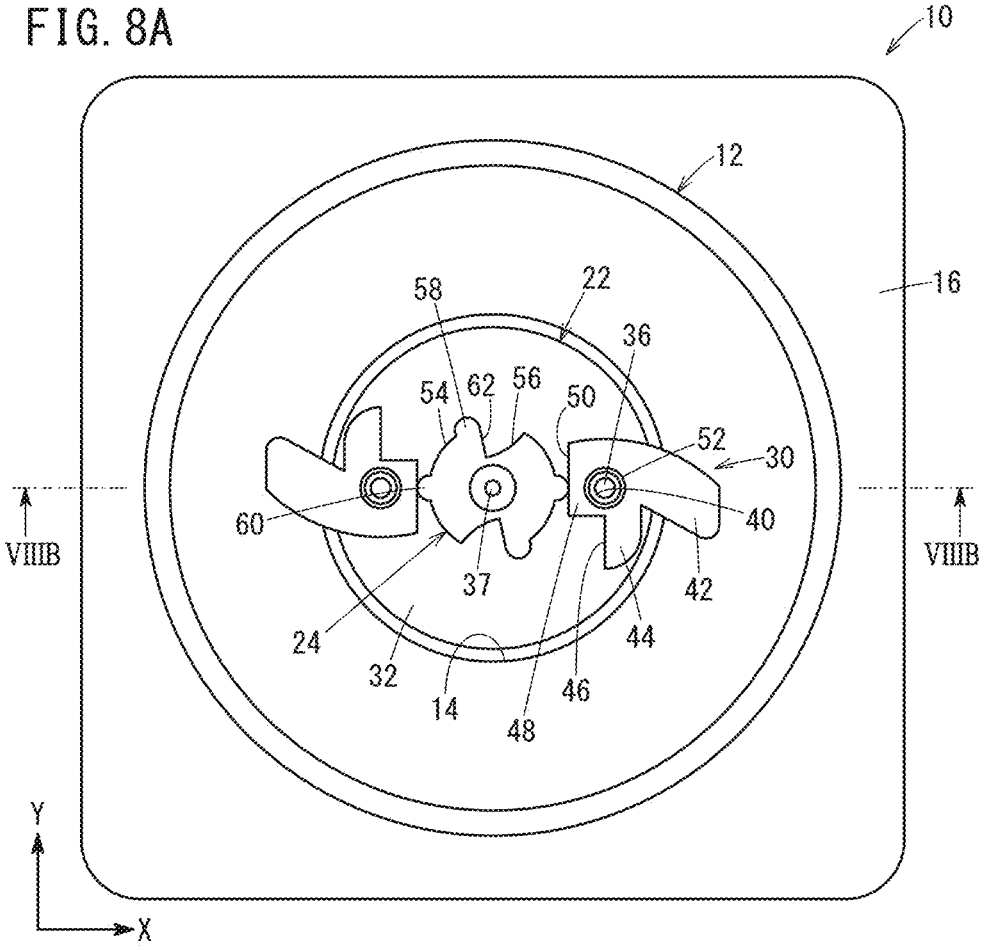
FIG. 8A is a top view of the clamp device during the clamping operation seen from the Z-axis positive direction side.
Figure 8B:
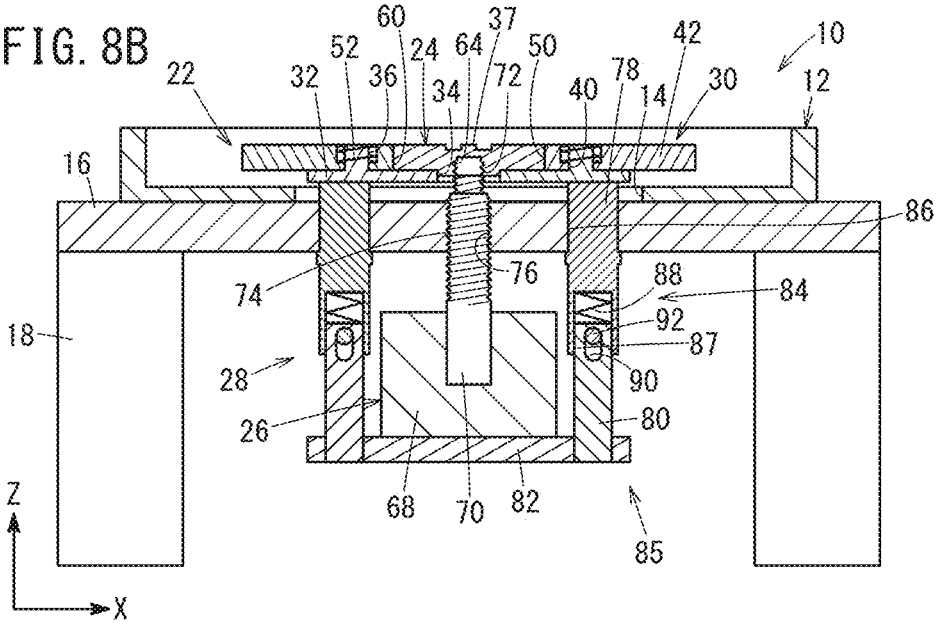
FIG. 8B is a cross section taken along line VIIIB-VIIIB shown in FIG. 8A.
Figure 9A:
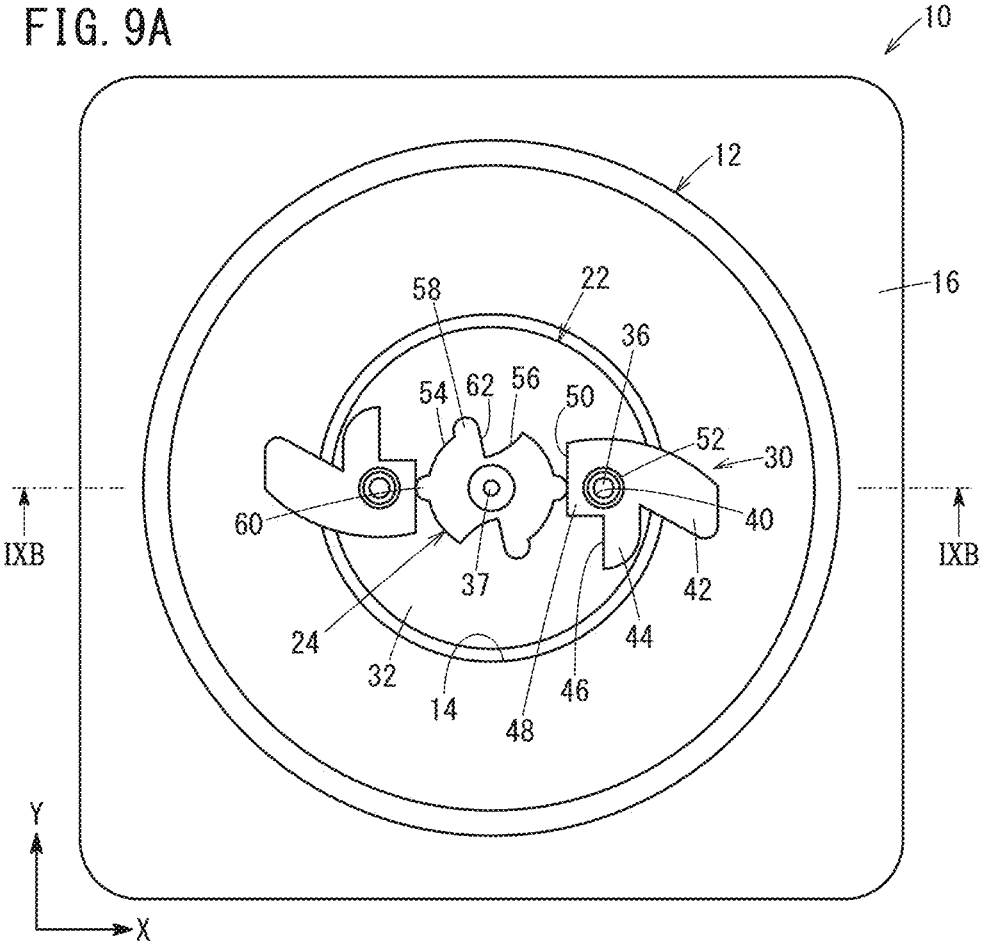
FIG. 9A is a top view of the clamp device during the clamping operation seen from the Z-axis positive direction side.
Figure 9B:
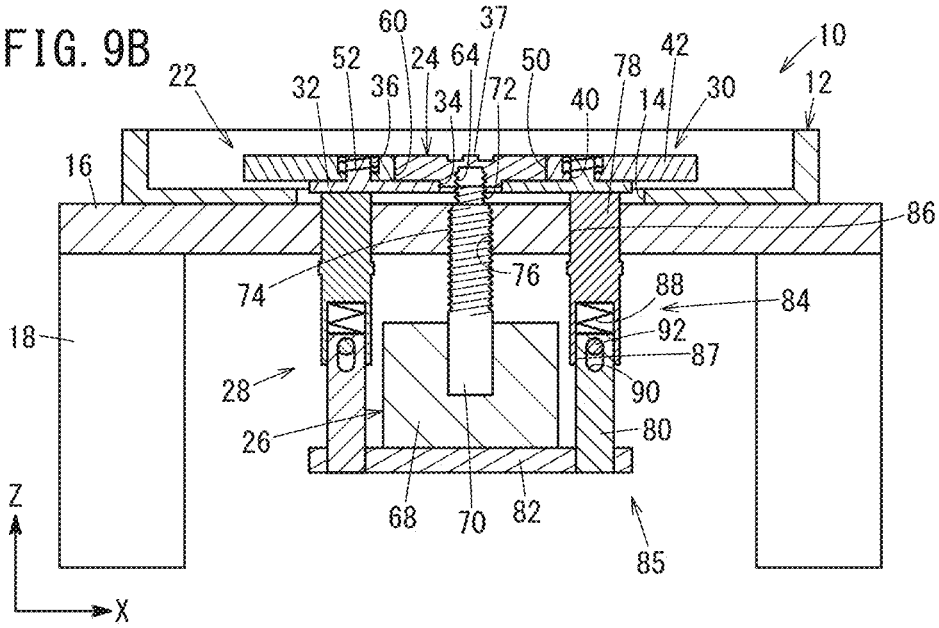
FIG. 9B is a cross section taken along line IXB-IXB shown in FIG. 9A.

FIG. 8A is a top view showing the clamp device 10 during the clamping operation, seen from the Z-axis positive direction side. FIG. 8B is a cross section taken along line VIIIB-VIIIB shown in FIG. 8A. FIG. 9A is a top view showing the clamp device 10 during the clamping operation, seen from the Z-axis positive direction side. FIG. 9B is a cross section taken along line IXB-IXB shown in FIG. 9A.

Figure 10A:
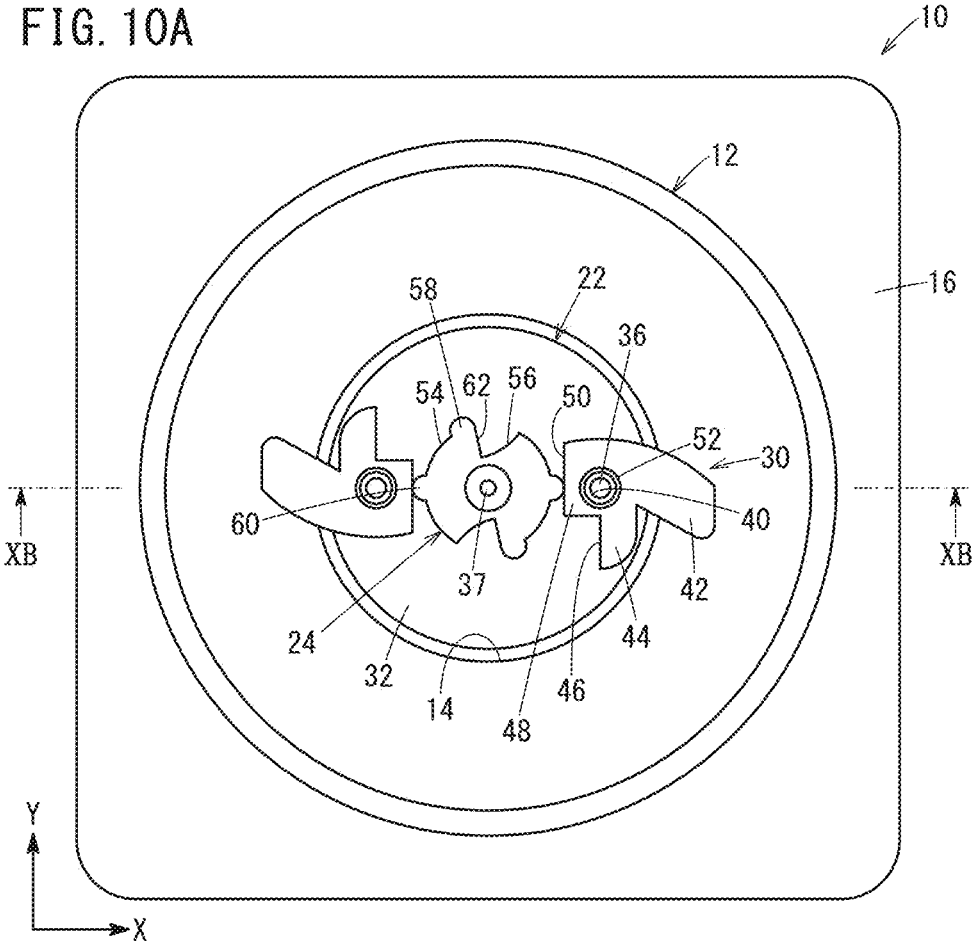
FIG. 10A is a top view of the clamp device having completed clamping of the workpiece, which is seen from the Z-axis positive direction side.
Figure 10B:
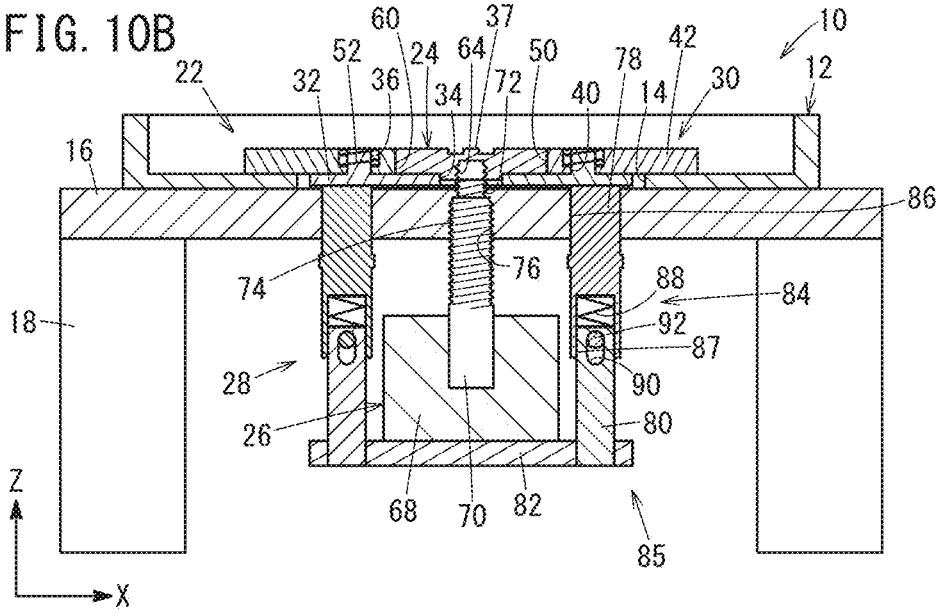
FIG. 10B is a cross section taken along line XB-XB shown in FIG. 10A.

FIG. 10A is a top view showing the clamp device 10 having completed the clamping of the workpiece 12, seen from the Z-axis positive direction side. FIG. 10B is a cross section taken along line XB-XB shown in FIG. 10A. The cover 20 is omitted in FIGS. 6A, 6B, 7A, 7B, 8A, 8B, 9A, 9B, 10A, and 10B.

In the description below, the direction in which the clamp arms 30 turn, the direction in which the cam block 24 turns, and the direction in which the driving shaft 70 rotates are shown as directions defined when the clamp device 10 is seen from the Z-axis positive direction side. Also, for the clamp device 10, the state in which the clamp arms 30 and the cam block 24 are at the positions shown in FIG. 2A is referred to as an unclamping state.

In the unclamping state, the first working faces 46 of the lever portions 44 of the clamp arms 30 are respectively in contact with the cam faces 62 of the notches 56 of the cam block 24 (FIG. 2A). When the driving shaft 70 rotates clockwise from the unclamping state, then the cam block 24 turns clockwise integrally with the driving shaft 70. At this time, the first cams 58 of the arc portions 54 of the cam block 24 respectively push the first working faces 46 of the lever portions 44 of the clamp arms 30, whereby the clamp arms 30 turns counterclockwise. The arm portions 42 of the clamp arms 30 then move to the side of the outer circumference of the clamp base 32 (FIGS. 6A and 6B).

As the cam block 24 further turns clockwise, the second cams 60 of the arc portions 54 of the cam block 24 respectively push the second working faces 50 of the head portions 48 of the clamp arms 30, whereby the clamp arms 30 further turn counterclockwise (FIGS. 6A and 6B).

Since the driving shaft 70 rotates clockwise relative to the workpiece base 16 with which the driving shaft 70 is screw-engaged, the driving shaft 70 moves in the Z-axis negative direction relative to the workpiece base 16. As the driving shaft 70 moves in the Z-axis negative direction, the cam block 24 accordingly moves in the Z-axis negative direction, and thus the entire clamping mechanism 22 moves in the Z-axis negative direction. Then, as the driving shaft 70 moves in the Z-axis negative direction, the motor 68, motor base 82, and second guide shafts 80 move to the Z-axis negative direction side (FIGS. 6A and 6B).

When the cam block 24 has turned clockwise by about 90° from the unclamping state, the stopper 38 abuts on an end of the arc-shaped groove 66 of the cam block 24, thereby restricting the clockwise turn of the cam block 24. At this time, the clamp arms 30 have turned counterclockwise by about 90° from the unclamping state (FIGS. 7A and 7B).

When the driving shaft 70 rotates clockwise with the turn of the cam block 24 being restricted by the stopper 38, the driving shaft 70 rotates clockwise with respect to the cam block 24, and moves in the Z-axis negative direction with respect to the workpiece base 16.

As the driving shaft 70 moves in the Z-axis negative direction, the motor 68, motor base 82, and second guide shafts 80 move in the Z-axis negative direction. At this time, since the pin holes 90 of the second guide shafts 80 perform a relative movement with respect to the pins 92 fixed to the first guide shafts 78, the first guide shafts 78 do not move in the Z-axis negative direction, and so the clamping mechanism 22 does not move in the Z-axis negative direction, either (FIGS. 8A and 8B).

As the driving shaft 70 further rotates clockwise to move in the Z-axis negative direction, the second guide shafts 80 also further move in the Z-axis negative direction. Then, the ends of the pin holes 90 of the second guide shafts 80 on the Z-axis positive direction side abut respectively on the pins 92 fixed to the first guide shafts 78, and then the first guide shafts 78 start moving in the Z-axis negative direction, and the clamping mechanism 22 also starts moving in the Z-axis negative direction (FIGS. 9A and 9B).

As the driving shaft 70 further rotates clockwise and the clamping mechanism 22 moves in the Z-axis negative direction, the arm portions 42 of the clamp arms 30 press the workpiece 12 against the workpiece base 16 from the Z-axis positive direction side (FIGS. 10A and 10B). The clamping of the workpiece 12 by the clamping mechanism 22 has thus been completed.

[Configuration of Motor Control Device]

The clamp device 10 includes a motor control device 100 configured to control the motor 68. FIG. 11 is a block diagram showing a configuration of the motor control device 100. The motor control device 100 includes a control unit 102 and a driver 104. The control unit 102 includes a position command unit 106, a torque obtaining unit 108, and a judgment unit 110.

The position command unit 106 is responsive to a clamping command for causing the clamping mechanism 22 to clamp the workpiece 12, or an unclamping command for causing the clamping mechanism 22 to unclamp the workpiece 12, which are inputted from a numerical control device (not shown), to thereby generate a position command value as a command value for a rotational position of the motor 68. On the basis of the position command value, the driver 104 controls electric current supplied to the motor 68.

On the basis of the current detection value of the electric current supplied from the driver 104 to the motor 68, the torque obtaining unit 108 obtains a torque of the motor 68. In accordance with the obtained torque, the judgment unit 110 judges that clamping of the workpiece 12 by the clamping mechanism 22 has been completed, or that unclamping has been completed. When the judgment unit 110 judges that clamping of the workpiece 12 has been completed, it sends a clamping completion signal to the numerical control device. When the judgment unit 110 judges that unclamping of the workpiece 12 has been completed, it sends an unclamping completion signal to the numerical control device.

[Judgment Process]

Figure 12:
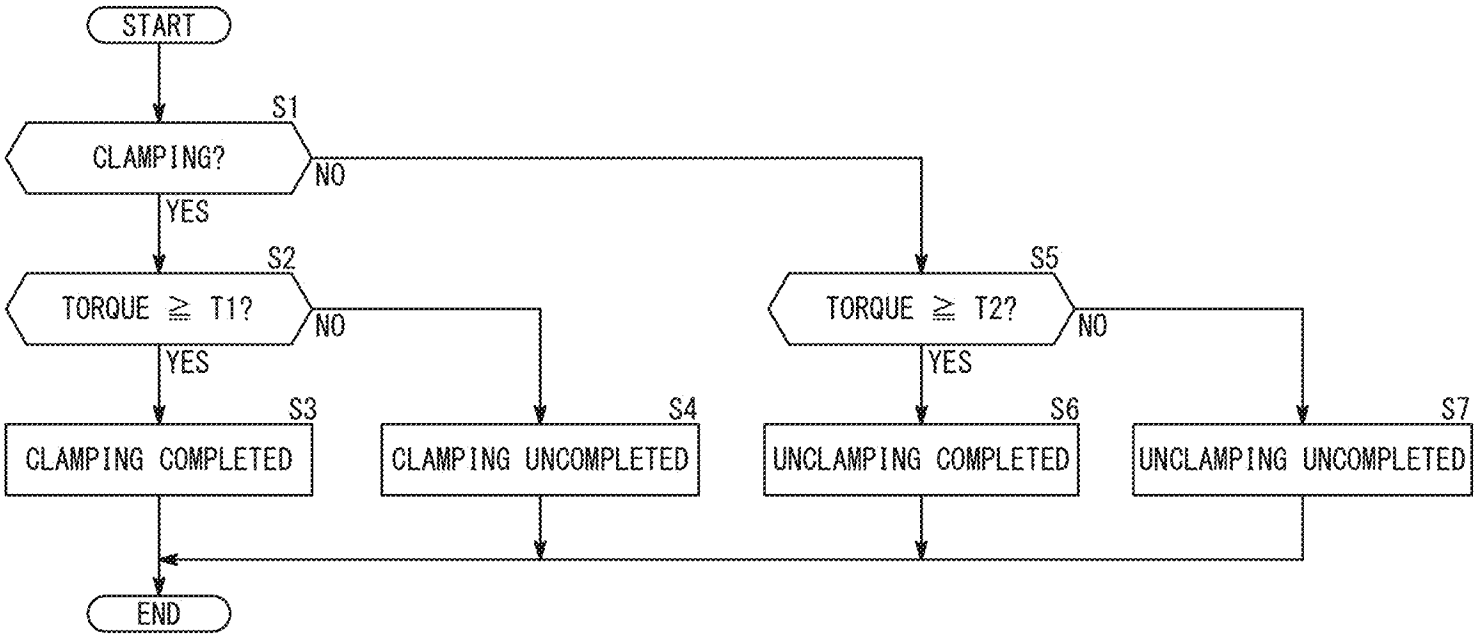
FIG. 12 is a flowchart showing the flow of a judgment process performed in a judgment unit.

FIG. 12 is a flowchart showing the flow of a judgment process performed in the judgment unit 110. At step S1, the judgment unit 110 judges whether the clamping mechanism 22 is starting to clamp the workpiece 12. When the clamping mechanism 22 is starting to clamp the workpiece 12, the process moves to step S2. When the clamping mechanism 22 is not starting to clamp the workpiece 12, the judgment unit 110 judges that the clamping mechanism 22 is starting to unclamp the workpiece 12, and the process moves to step S5. The judgment as to whether the clamping mechanism 22 is starting to clamp the workpiece 12 or starting to unclamp the workpiece 12 may be made in accordance with the clamping command or unclamping command inputted to the position command unit 106, or may be made in accordance with the position command value outputted from the position command unit 106.

At step S2, the judgment unit 110 judges whether or not the magnitude of the torque of the motor 68 is equal to or larger than a certain value T1. When the magnitude of the torque of the motor 68 is equal to or larger than the certain value T1, the process moves to step S3. When the magnitude of the torque of the motor 68 is smaller than the certain value T1, the process moves to step S4.

At step S3, the judgment unit 110 judges that clamping of the workpiece 12 has been completed, and then terminates the process. At step S4, the judgment unit 110 judges that clamping of the workpiece 12 is uncompleted, and then terminates the process.

At step S5, the judgment unit 110 judges whether or not the magnitude of the torque of the motor 68 is equal to or larger than a certain value T2. When the magnitude of the torque of the motor 68 is equal to or larger than the certain value T2, the process moves to step S6. When the magnitude of the torque of the motor 68 is smaller than the certain value T2, the process moves to step S7.

At step S6, the judgment unit 110 judges that unclamping of the workpiece 12 has been completed, and then terminates the process. At step S7, the judgment unit 110 judges that unclamping of the workpiece 12 is uncompleted, and then terminates the process.

Which of the certain value T1 and the certain value T2 should be larger/smaller is not particularly specified, and they may be the same value. What is needed is that the certain value T1 and the certain value T2 be set such that the judgment can be made that the clamping mechanism 22 has completed clamping of the workpiece 12 and that it has completed unclamping of the workpiece 12.

[Functions and Effects]

It is necessary to place the workpiece 12 in close contact with the workpiece base 16 in order to improve machining accuracy of the workpiece 12 by the machine tool. It is also necessary to press the workpiece 12 against the workpiece base 16 in order to firmly clamp the workpiece 12. When a mechanism for pressing the workpiece 12 against the workpiece base 16 (hereinafter referred to as a pressing mechanism) is disposed above the workpiece 12, then a tool may interfere with the pressing mechanism during machining. Also, when a mechanism for magnetically attracting the workpiece 12 (hereinafter referred to as an attracting mechanism) is provided under the workpiece 12, interference between tools and the attracting mechanism is prevented, but only magnetic workpieces 12 can be loaded.

The clamp device 10 of this embodiment includes, as the clamping mechanism 22, the clamp arms 30 for clamping the workpiece 12, and the cam block 24 that turns to thereby turn the clamp arms 30. The driving shaft 70 is connected to the cam block 24, and the motor 68 for rotating the driving shaft 70 is disposed across the workpiece base 16 from the clamping mechanism 22. In this way, the clamp device 10 is not disposed above the workpiece 12, and interference between tools and the clamp device 10 is prevented.

Furthermore, in the clamp device 10 of this embodiment, the driving shaft 70 is screw-engaged with the second female screw portion 76 of the workpiece base 16, and, as the driving shaft 70 rotates, the clamp arms 30 move to the Z-axis negative direction side together with the driving shaft 70. Thus, the clamp arms 30 can be moved toward the workpiece base 16, and the workpiece 12 can be pressed against the workpiece base 16, irrespective of whether the material of the workpiece 12 is magnetic material or nonmagnetic material.

Further, the clamp device 10 of this embodiment has the first guide shafts 78 connected to the clamp base 32 and the second guide shafts 80 connected to the motor base 82, and the coupling portions 84 are provided between the first guide shafts 78 and the second guide shafts 80 so as to permit the second guide shafts 80 to move, within a certain range, relative to the first guide shafts 78 in the Z-axis direction. Thus, in a state where turning of the cam block 24 is being restricted by the stopper 38, the driving shaft 70 rotates relative to the cam block 24, and then the second guide shafts 80 pull the first guide shafts 78 to the Z-axis negative direction side, and as a result the clamping mechanism 22 moves toward the workpiece base 16. It is thus possible to press the workpiece 12 against the workpiece base 16 by the clamp arms 30, with the arm portions 42 of the clamp arms 30 being completely extended to the outer circumference side of the clamp base 32.

Further, the clamp device 10 of this embodiment has the arc-shaped groove 66 formed in the surface of the cam block 24 that faces the clamp base 32, and also has the stopper 38 formed on the surface of the clamp base 32 that faces the cam block 24, the stopper being engaged into the arc-shaped groove 66. This limits the range in which the cam block 24 can turn, thereby allowing the driving shaft 70 to rotate relative to the cam block 24.

Furthermore, the clamp device 10 of this embodiment includes the torque obtaining unit 108 configured to obtain the torque of the motor 68, and the judgment unit 110 configured to judge that the workpiece 12 is being clamped by the clamp arms 30 when the obtained torque is equal to or greater than the certain value T1. Thus, the clamp device 10 prevents excessive force from acting on the workpiece 12 from the clamp arms 30, and thus can clamp the workpiece 12 without deforming the workpiece 12.

[Modifications]

Figure 13A:
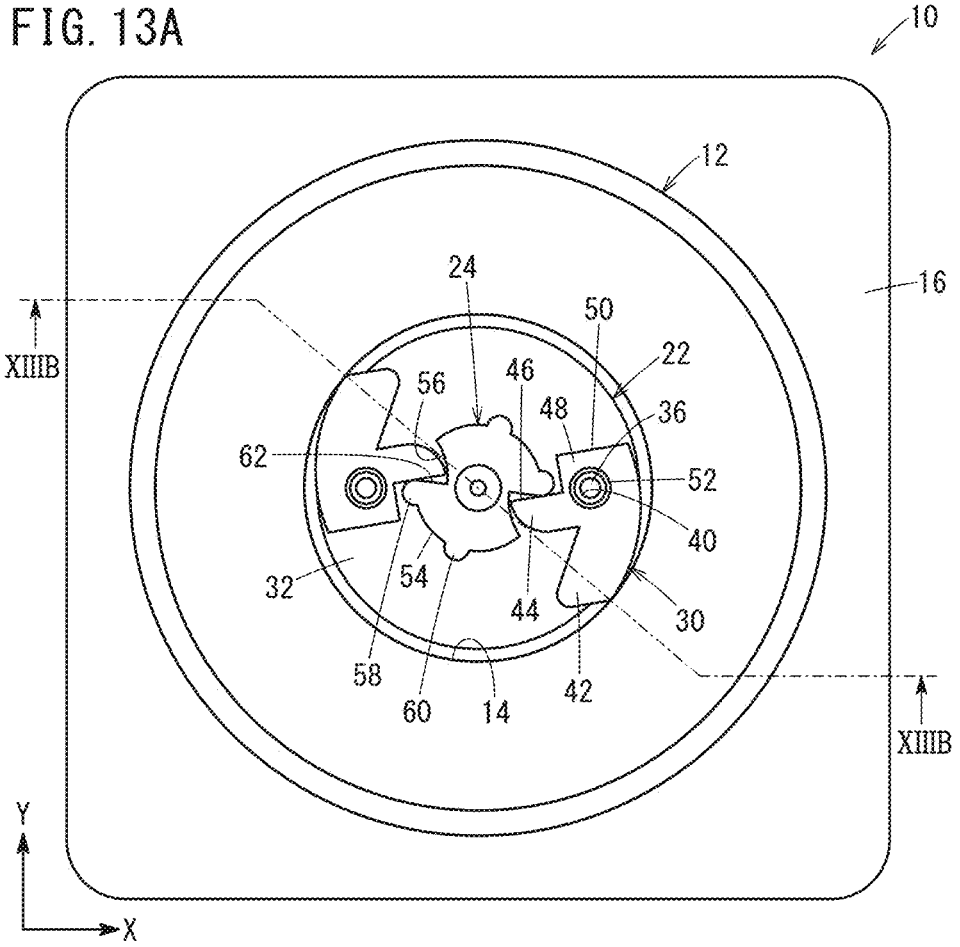
FIG. 13A is a top view of a clamp device having completed clamping of a workpiece, which is seen from the Z-axis positive direction side.
Figure 13B:
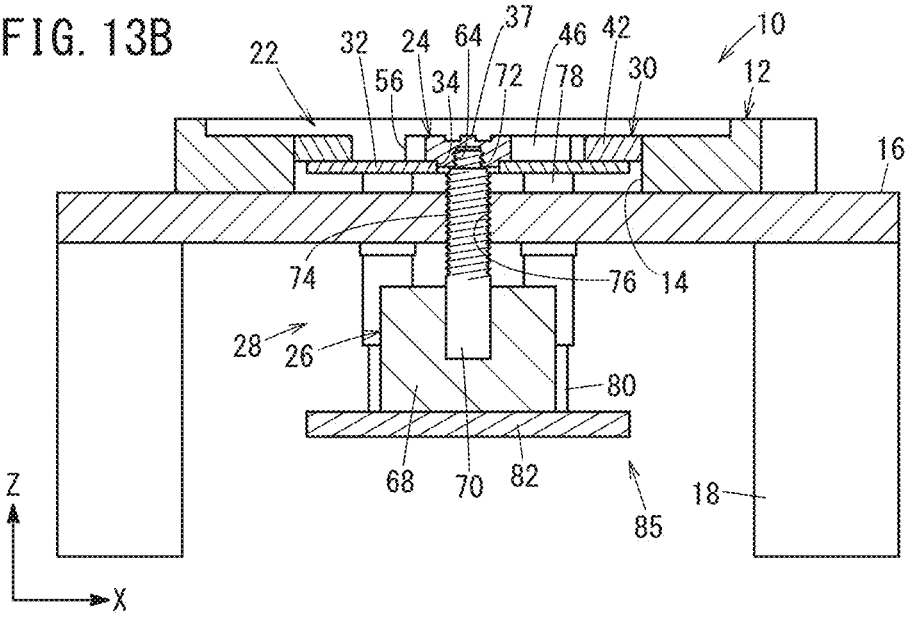
FIG. 13B is a cross section taken along line XIIIB-XIIIB shown in FIG. 13A.

FIG. 13A is a top view of a clamp device 10 that has completed clamping of the workpiece 12, which is seen from the Z-axis positive direction side. FIG. 13B is a cross section taken along line XIIIB-XIIIB in FIG. 13A.

In the first embodiment, the clamp arms 30 press down the upper surface of the workpiece 12 from the Z-axis positive direction side onto the workpiece base 16. On the other hand, as shown in FIGS. 13A and 13B, the workpiece 12 may be held by pressing side surfaces of the clamp arms 30 against an inner circumferential surface of the through hole 14 of the workpiece 12. In a state in which the clamp arms 30 are holding the workpiece 12, the clamping mechanism 22 is moved in the Z-axis negative direction, whereby the workpiece 12 can be pressed against the workpiece base 16.

Further, in the first embodiment, the clamping mechanism 22 is inserted into the through hole 14 of the workpiece 12 and clamps the workpiece 12 on the inner circumference side of the workpiece 12, but the workpiece 12 may be clamped on an outer circumference side of the workpiece 12.

[Technical Ideas Obtained from Embodiments]

Technical ideas that can be grasped from the embodiments above will be recited below.

The clamp device (10) for clamping a workpiece (12) includes: clamp arms (30) configured to restrict movement of the workpiece by turning; a cam block (24) configured to turn the clamp arms by turning; a workpiece base (16) on which the workpiece is placed; a driving shaft (70) that is a member formed in a rod shape, the driving shaft being configured to be screw-engaged, at a middle portion thereof, with a screw portion (76) formed in the workpiece base and also screw-engaged, at one end thereof, with a screw portion (64) formed on a pivot axis of the cam block; a motor (68) configured to rotate the driving shaft to thereby turn the cam block and to move the driving shaft in an axial direction; and a coupling mechanism (85) configured to couple the driving shaft and the clamp arms and move the clamp arms toward the workpiece base as the driving shaft is moved in the axial direction. It is thus possible to press the workpiece against the workpiece base irrespective of whether the material of the workpiece is magnetic material or nonmagnetic material.

In the clamp device above, the coupling mechanism may include: a clamp base (32) on which the clamp arms are provided; and a suspension mechanism (28) configured to suspend the motor with respect to the clamp base. It is thus possible to integrally move the clamp base and motor in the axial direction.

In the clamp device above, the suspension mechanism may include: first guide shafts (78) provided so as to be movable integrally with the clamp base; second guide shafts (80) provided so as to be movable integrally with the motor; and coupling portions (84) configured to couple the first guide shafts and the second guide shafts and to permit movement of the second guide shafts with respect to the first guide shafts in the axial direction within a certain range. It is thus possible to press the workpiece against the workpiece base by the clamp arms in a state in which the clamp arms are completely extended on the outer circumference side of the clamp base.

In the clamp device above, the cam block may have an arc-shaped groove (66) having an arc shape, formed in a side surface thereof in a direction of the pivot axis, and the clamp base may include a stopper (38) configured to be engaged with the arc-shaped groove and restrict a range in which the cam block turns. It is thus possible to restrict the turning range of the cam block and allow the driving shaft to perform a relative rotation with respect to the cam block.

The clamp device may further include: a torque obtaining unit (108) configured to obtain a torque of the motor; and a judgment unit (110) configured to judge that the workpiece is clamped by the clamp arms when the obtained torque is equal to or greater than a certain value (T1).

Thus, the clamp device can prevent excessive force from acting on the workpiece from the clamp arms and clamp the workpiece without deforming the workpiece.

The present invention is not particularly limited to the embodiment described above, and various modifications are possible without departing from the essence and gist of the present invention.

What is claimed is:

1. A clamp device for clamping a workpiece, comprising:

clamp arms configured to restrict movement of the workpiece by turning;

a cam block configured to turn the clamp arms by turning;

a workpiece base on which the workpiece is placed;

a driving shaft that is a member formed into a rod shape, the driving shaft being configured to be screw-engaged, at a middle portion thereof, with a screw portion formed in the workpiece base and also screw-engaged, at one end thereof, with a screw portion formed on a pivot axis of the cam block;

a motor configured to rotate the driving shaft to thereby turn the cam block and move the driving shaft in an axial direction; and a coupling mechanism configured to couple the driving shaft and the clamp arms and move the clamp arms toward the workpiece base as the driving shaft is moved in the axial direction.

2. The clamp device according to claim 1, wherein the coupling mechanism comprises:

a clamp base on which the clamp arms are provided; and a suspension mechanism configured to suspend the motor with respect to the clamp base.

3. The clamp device according to claim 2, wherein the suspension mechanism comprises:

first guide shafts provided so as to be movable integrally with the clamp base;

second guide shafts provided so as to be movable integrally with the motor; and coupling portions configured to couple the first guide shafts and the second guide shafts and to permit movement of the second guide shafts with respect to the first guide shafts in the axial direction within a certain range.

4. The clamp device according to claim 2, wherein the cam block has an arc-shaped groove having an arc shape, formed in a side surface thereof in a direction of the pivot axis, and the clamp base includes a stopper configured to be engaged with the arc-shaped groove and restrict a range in which the cam block turns.

5. The clamp device according to claim 1, further comprising:

a torque obtaining unit configured to obtain a torque of the motor; and a judgment unit configured to judge that the workpiece is clamped by the clamp arms when the obtained torque is equal to or greater than a certain value.

* * * * *